US006270383B1

(12) United States Patent
Wielsch et al.

(10) Patent No.: US 6,270,383 B1
(45) Date of Patent: Aug. 7, 2001

(54) RESILIENT TERMINAL INCLUDING CONDUCTOR CENTERING MEANS

(75) Inventors: Thomas Wielsch, Horn-Bad Meinberg; Jochen Reese, Detmold, both of (DE)

(73) Assignee: Weidmüller Interface GmbH & Co., Detmold (DE)

( * ) Notice: Subject to any disclaimer, the term of this patent is extended or adjusted under 35 U.S.C. 154(b) by 0 days.

(21) Appl. No.: 09/542,849

(22) Filed: Apr. 4, 2000

(30) Foreign Application Priority Data

Apr. 14, 1999 (DE) ..... 199 16 755

(51) Int. Cl.[7] ..... H01R 4/48
(52) U.S. Cl. ..... 439/828
(58) Field of Search ..... 439/828, 835, 439/739

(56) References Cited

U.S. PATENT DOCUMENTS 985,821 * 3/1911 Manson ..... 439/739
3,757,281 * 9/1973 Woertz et al. ..... 439/724
5,860,837 * 1/1999 Bock et al. ..... 439/828
5,879,204 3/1999 Delarue et al. .
5,938,484 8/1999 Beege et al. .

FOREIGN PATENT DOCUMENTS

DE 2 213 301 6/1973 (DE) .
DE 31 22 303 A1 1/1983 (DE) .
DE 42 16 927 C1 9/1993 (DE) .
DE 42 37 733 C1 12/1993 (DE) .
DE 296 08 178 U1 9/1996 (DE) .
DE 196 14 977 A1 10/1996 (DE) .

* cited by examiner

*Primary Examiner*—Neil Abrams
*Assistant Examiner*—Brian S. Webb
(74) *Attorney, Agent, or Firm*—Laubscher & Laubscher

(57) ABSTRACT

A resilient electrical terminal includes a pair of beveled centering surfaces that cooperate to center a conductor relative to the side walls of the clamping opening through which a bus bar and the conductor extend in clamped side-by-side conductive relation. A groove contained in the adjacent surface of the bus bar centers the conductor relative to the bus bar.

5 Claims, 4 Drawing Sheets

RESILIENT TERMINAL INCLUDING CONDUCTOR CENTERING MEANS

FIELD OF THE INVENTION

This invention relates to a resilient electrical terminal including first centering means on the resilient member for centering a conductor between the side edges of a clamping opening through which the conductor and a bus bar extend in clamped side-by-side conductive relation. Second centering means on the bus bar center the conductor relative to the bus bar.

BACKGROUND OF THE INVENTION

Resilient electrical terminals operable to clamp a bare conductor in electrically conductive side-by-side relation with a bus bar are well known in the prior art, as shown by the U.S. Pat. No. 5,879,204 to Delarue, et al., and U.S. Pat. No. 5,938,484, Beege, et al., and the German patent Nos. DE 296 08 178 U1 and DE 42 377 33 C1, among others.

In the known resilient terminals, the bus bar and the conductor are inserted within a clamping opening contained in a first leg of the resilient body that extends generally normal to the base portion of the body. The second leg portion of the resilient body is bent back over the base portion, and biases the conductor and the bus bar in clamped side-by-side conductive relation against a clamping edge of the clamping opening. Generally, only one electrical conductor can be inserted into the opening for clamping to the bus bar in positive electrically-conductive engagement.

SUMMARY OF THE INVENTION

Accordingly, a primary object of the present invention is to clamp one or more conductors in positive electrical contact with a bus bar that extends in side-by-side relation with the conductor through a common clamping opening contained in the resilient terminal element.

According to a more specific object of the invention, first centering means are provided for centering a conductor relative to the side walls of the clamping opening. The first centering means comprise a pair of spaced beveled surfaces on the clamping edge that are initially inwardly inclined toward a central portion of the clamping edge.

In accordance with another object of the invention, second centering means are provided for centering the conductor relative to the bus bar. Preferably, these second centering means comprise a longitudinal groove that is contained in the surface of the bus bar adjacent the conductor.

According to another object of the invention, the surface of the bus bar adjacent the conductor is ribbed to prevent longitudinal displacement of the conductor relative to the bus bar.

As a consequence of the invention, it is possible to firmly and positively clamp to the bus bar not only one centered conductor, but also a plurality of conductors, including conductors having different diameters. More particularly, when the conductors are in the clamped condition, they are displaced centrally inwardly by the beveled surfaces of the clamping edge of the clamping opening. This applies also to the conductors that are not in direct engagement with the clamping edge, but are biased together centrally inwardly by the beveled edges. The invention also facilitates the simultaneous electrical connection of a plurality of conductors of different diameters, as well as the connection of multiwire and even fine-wire conductors.

BRIEF DESCRIPTION OF THE DRAWINGS

Other objects and advantages of the invention will become apparent from a study of the following specification, when viewed in the light of the accompanying drawings, in which.

DETAILED DESCRIPTION

Figure 1:
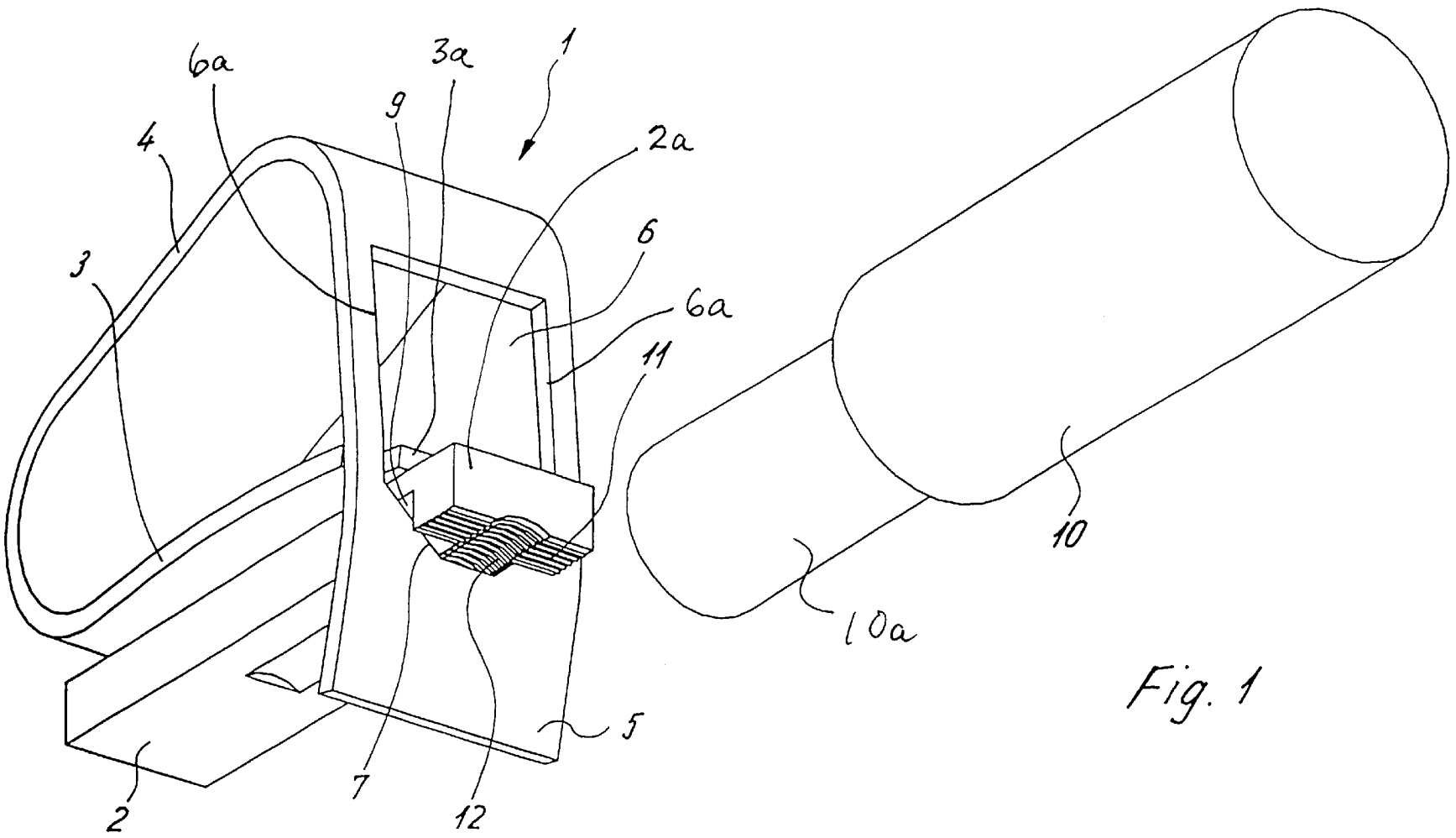
FIG. 1 is an exploded perspective view illustrating the conductor prior to connection with the resilient terminal assembly, the bus bar and biasing arm being in their normal closed positions.

Referring now more particularly to FIG. 1, the resilient terminal of the present invention includes a resilient generally U-shaped member 1 having a base portion 4, a clamping leg portion 5 extending orthogonally from one end of said base portion, and a biasing leg portion 3 that is connected with the other end of the base portion 4 and is bent backwardly toward a position generally parallel with and spaced from the base portion. As is known in the art, the free extremity 3*a* of the biasing leg portion 3 is notched and extends within a clamping opening or window 6 contained in the clamping leg portion 5. The clamping window 6 is generally rectangular and includes a pair of side edges 6*a,* a transverse end edge 6*b* adjacent the base portion 4, and a clamping end edge portion 7 remote from the base portion 4. Extending between the end extremity 3*a* of the biasing leg portion 3 and the clamping edge 7 of the window 6 is an electrically conductive bus bar 2. The bus bar 2 extends adjacent the biasing leg 3 and has an end portion 2*a* that extends through the window opening 6.

Figure 2:
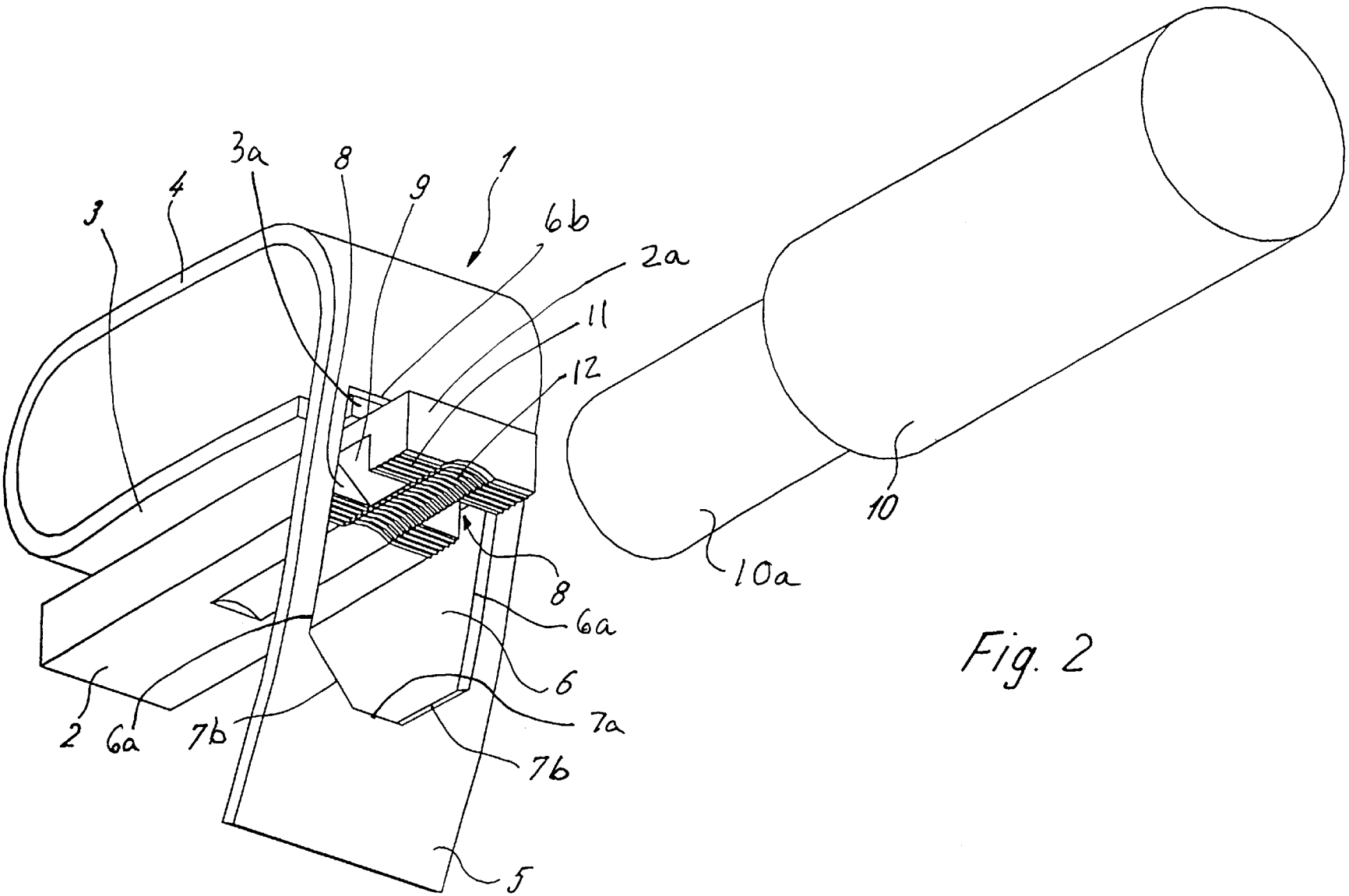
FIG. 2 is a perspective view illustrating the bus bar and biasing arm displaced to the open position to permit entry of the bare end of the conductor into the clamping opening.
Figure 3A:
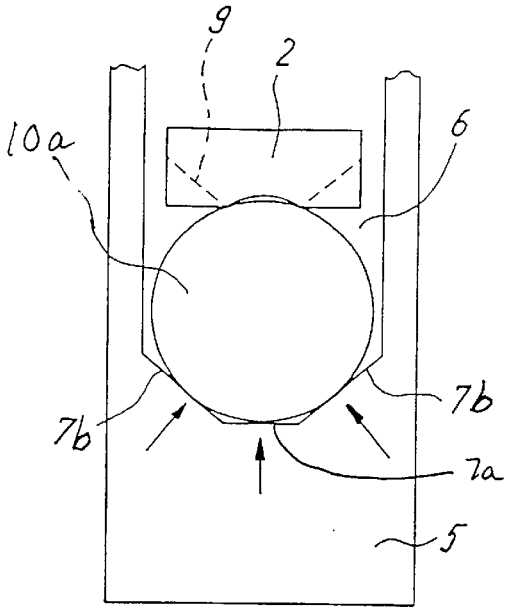
FIG. 3*a* is a detailed end view illustrating a single conductor clamped in centered position relative to the clamping opening and to the bus bar.

When the bus bar 2 and the biasing leg 3 are displaced from their closed positions of FIG. 1 toward the open positions of FIG. 2, the bare end portion 10*a* of the insulated conductor 10 is adapted for insertion within the clamping opening 6 between the bus bar 2 and the clamping edge 7. In accordance with a characterizing feature of the present invention, the clamping edge 7 includes a central portion 7*a,* and a pair of beveled portions 7*b* on opposite sides of the central portion 7*a.* The inclined surfaces of the beveled edge portions 7*b* serve to center the conductor 10 between the side edges 6*a* as best shown in FIG. 3*a*. In this case, the downward force applied to the bare conductor 10 by the biasing arm 3 and the bus bar 2 produces centering of the bare cable end 10*a* between the side edges 6*a,* owing to the angular inclination of the bearing forces produced by the beveled edges 7*b*.

Figure 3B:
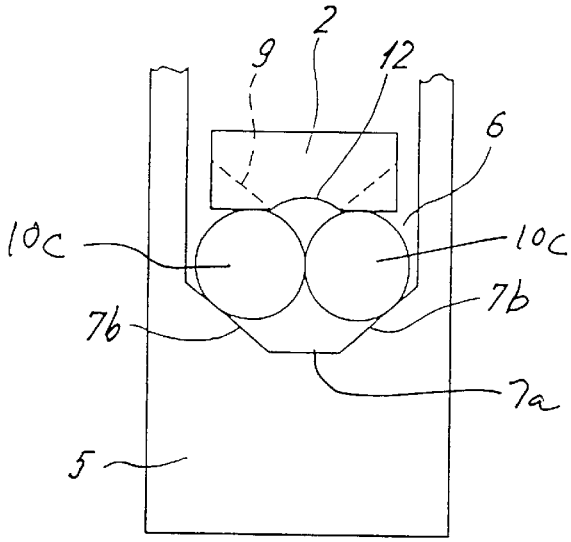
FIGS. 3*b* and 3*c* illustrate the clamping in the opening of two pairs of conductors of equal and unequal diameters, respectively.
Figure 3C:
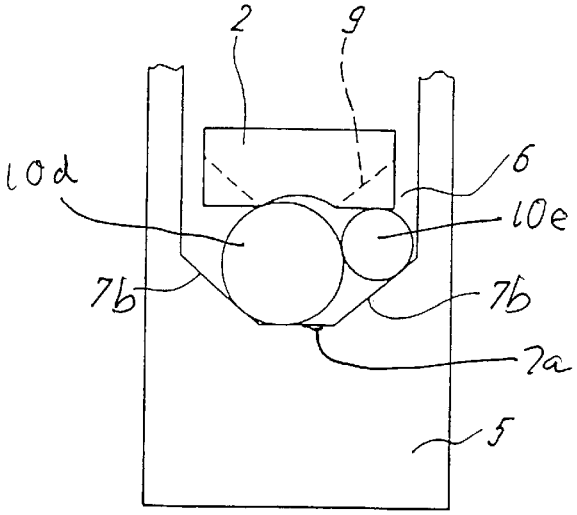
Figure 3D:
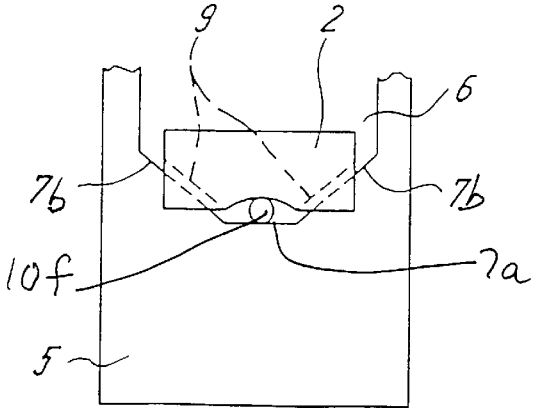
FIG. 3*d* illustrates the clamping in the opening of a conductor having a very small diameter.

Referring to FIG. 3*b,* when two bare conductors 10*c* of equal diameter are introduced within the clamping window 6, the downward force applied to the bus bar 2 by the biasing leg 3 causes the two conductors 10*c* to engage the edges of the beveled portions 7*b,* respectively, as well as to be forced into conductive engagement with each other. Similarly, as shown in FIG. 3*c,* when a pair of conductor ends 10*d* and 10*e* of unequal diameter are introduced within the opening 6, the conductors are biased both into engagement with the bevel end center portions 7*b* and 7*a* of the clamping edge 7, and also into conductive engagement with each other. As shown in FIG. 3*d,* a conductor 10*f* having a relatively small diameter is maintained directly by the bus bar 2 in direct engagement with the center portion 7*a* of the clamping edge 7. In this case, the beveled edge portions 7*b* extend within corresponding notches 8 that are contained in the adjacent face of the bus bar 2. The recesses or notches 8 have inclined bottom walls 9 that are parallel with the corresponding surface 7*b* of the edge portion of the opening 6, thereby to receive the beveled surfaces 7*b* of the clamping edge 7 when the bus bar is in the closed conditions of FIGS. 1 and 3*d*.

Figure 4:
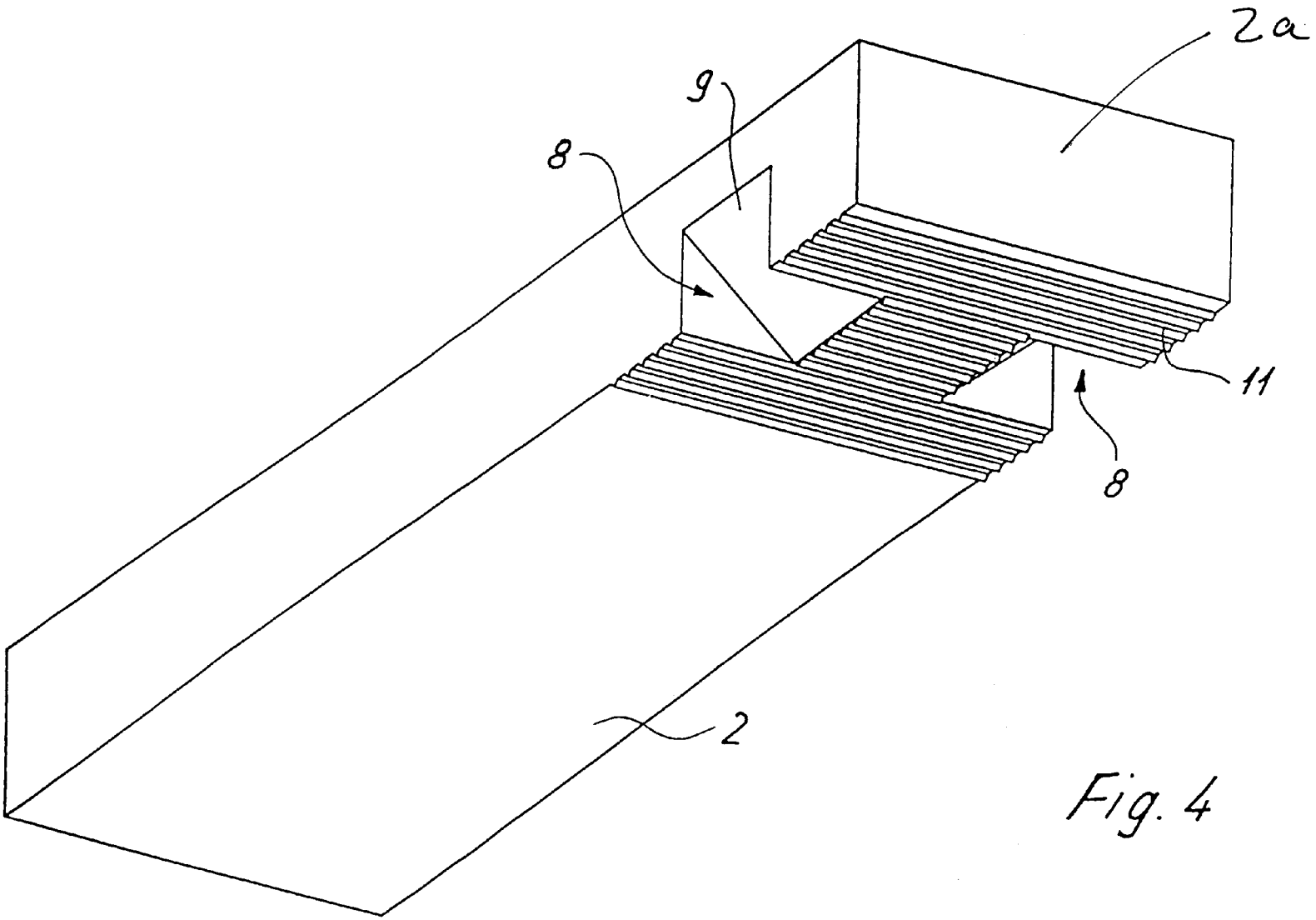
FIG. 4 is a bottom perspective view of the ribbed and notched end of the bus bar.

Preferably, the surface of the bus bar 2 adjacent the clamping edge 7 is ribbed to define a rib portion 11. A longitudinal groove 12 is provided in the end portion 2*a* of the bus bar 2, thereby to assist in centering the bare conductor 10*a* relative to the bus bar 2. In the embodiment of FIG. 4, the longitudinal groove 12 of FIG. 2 has been omitted.

While in accordance with the provisions of the Patent Statutes, the preferred forms and embodiments of the invention have been illustrated and described, it will be apparent to those skilled in the art that various changes may be made without deviating from the inventive concepts set forth above.

What is claimed is:

1. A resilient electrical terminal (1) operable to clamp a bus bar (2) and at least one conductor (10) in parallel side-by-side electrical engagement, comprising:

(a) a resilient electrical contact member including a central base portion (4), a clamping leg portion (5) extending generally orthogonally relative to one end of said base portion, and a biasing leg portion (3) connected with the end of said base portion, said biasing leg portion being angularly arranged at an acute angle relative to said base portion, thereby to cause said biasing leg portion to extend over said base portion, said biasing leg portion being resiliently biased away from said base portion and terminating at an free end (3*a*), said clamping leg portion containing a generally rectangular clamping opening (6) receiving said biasing leg portion free end, said clamping opening including a pair of generally parallel side edges (6*a*), and a clamping edge (7) remote from said base portion toward which said biasing leg portion is resiliently biased;

(b) an electrically conductive bus bar (2) arranged generally parallel with said clamping leg portion adjacent the side thereof that is remote from said base portion, said bus bar having a free end portion (2*a*) that extends within said clamping opening between said clamping edge and said biasing leg portion free end (3*a*);

(c) first conductor centering means (7) for centering between said clamping opening side edges a conductor (10) inserted between said bus bar and said clamping edge, said first conductor centering means comprising a recess defined in said clamping edge, said recess including a central edge portion (7*a*), and a pair of beveled centering portions (7*b*) on opposite sides of said central portion, said beveled portions extending toward said clamping opening side edges, respectively; and (d) bus bar centering means for centering said bus bar between said clamping opening side edges, respectively, said bus bar centering means comprising a pair of centering recesses (8) contained in said bus bar free end portion adjacent said clamping opening clamping edge, said centering recesses being arranged to receive said clamping edge beveled centering portions (7*b*), respectively.

2. A resilient electrical terminal as defined in claim 1, wherein said centering recesses in said bus bar include angled bottom walls (9) that are generally parallel with said beveled centering edges, respectively.

3. A resilient electrical terminal as defined in claim 1, wherein the surface of said bus bar adjacent said clamping edge contains a plurality of ribs (11) extending generally parallel with said clamping edge.

4. A resilient electrical terminal as defined in claim 1, and further including:

(e) second conductor centering means (12) for centering the conductor relative to said bus bar.

5. A resilient electrical connector as defined in claim 1, wherein said second conductor centering means comprises a longitudinal groove (12) contained in the face of the surface of said bus bar that is adjacent said clamping edge, said groove extending longitudinally of said bus bar.

* * * * *